United States Patent [19]

Vogel et al.

[11] Patent Number: 4,924,572

[45] Date of Patent: May 15, 1990

[54] THREAD SNIPS

[76] Inventors: David S. Vogel, 3841 W. Wood Lake Ct.; Donald E. Vogel, 12390 E. 100 N., both of Columbus, Ind. 47201

[21] Appl. No.: 407,320

[22] Filed: Sep. 14, 1989

Related U.S. Application Data

[63] Continuation of Ser. No. 293,991, Jan. 6, 1989, abandoned.

[51] Int. Cl.[5] ..... B26B 13/00

[52] U.S. Cl. ..... 30/253; 30/260

[58] Field of Search ..... 30/245, 253, 254, 260–262

[56] References Cited

U.S. PATENT DOCUMENTS

| | | | |
|---|---|---|---|
| 879,064 | 2/1908 | Prohaska | 30/260 |
| 1,947,964 | 2/1934 | Beckmann | 76/104 |
| 3,453,651 | 7/1969 | Wertepny, Sr. | 30/253 |
| 3,453,731 | 7/1969 | Wertepny, Sr. | 30/267 |
| 3,524,363 | 8/1970 | Wertepny, Sr. | 76/104 |
| 3,608,196 | 9/1971 | Wiss | 30/253 |
| 3,750,282 | 8/1983 | Easton et al. | 30/254 |
| 3,791,013 | 2/1974 | Rogers | 30/254 |
| 3,827,316 | 8/1974 | Laurenti | 76/104 |
| 4,048,721 | 9/1977 | Gunson | 30/254 |
| 4,089,113 | 5/1978 | Moritz et al. | 30/253 |
| 4,250,620 | 2/1981 | Nishikawa | 30/254 |
| 4,435,901 | 3/1984 | Nishikawa | 30/254 |
| 4,715,122 | 12/1987 | Linden | 30/254 |

*Primary Examiner*—Douglas D. Watts

*Attorney, Agent, or Firm*—McAndrews, Held & Malloy, Ltd.

[57] ABSTRACT

The thread snips include two metal blades connected together, adjacent their rounded, rear ends, so that their pointed, front ends may be moved or pivoted relative to each other, in planes generally parallel with the planes of the metal blades, between open and closed positions. The rearward portion of each metal blade has a reduced thickness. Plastic inserts are molded onto these rearward, reduced thickness portions so that the inner facing side surfaces of the plastic inserts define a smooth continuation of the inner facing side surfaces of the metal blades. The rearward ends of the plastic inserts are thicker than their forward ends. The increased thicknesses force the rear ends of the metal blades apart, and thus cause the blades, forward of the point of connection, to bend or arch.

16 Claims, 4 Drawing Sheets

FIG. 5
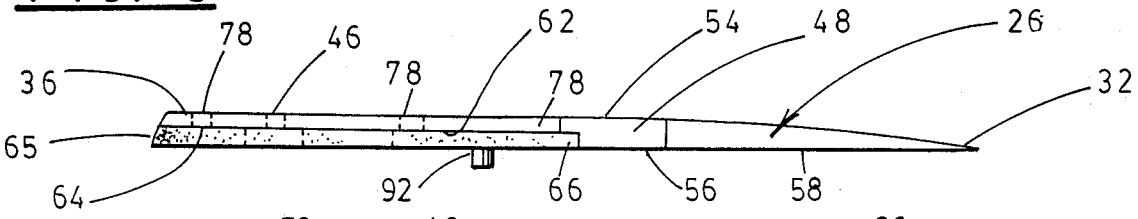
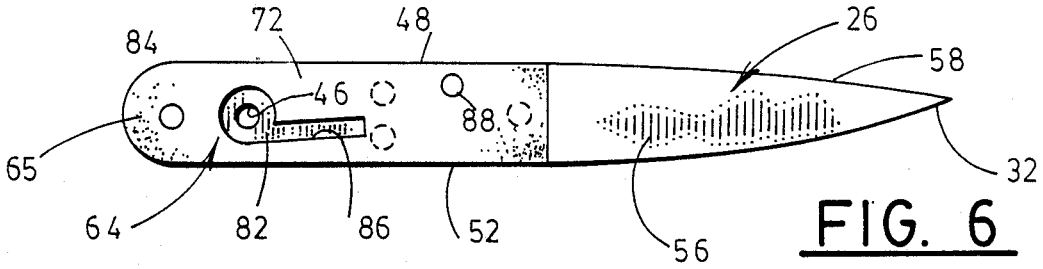
FIG. 6
FIG. 7
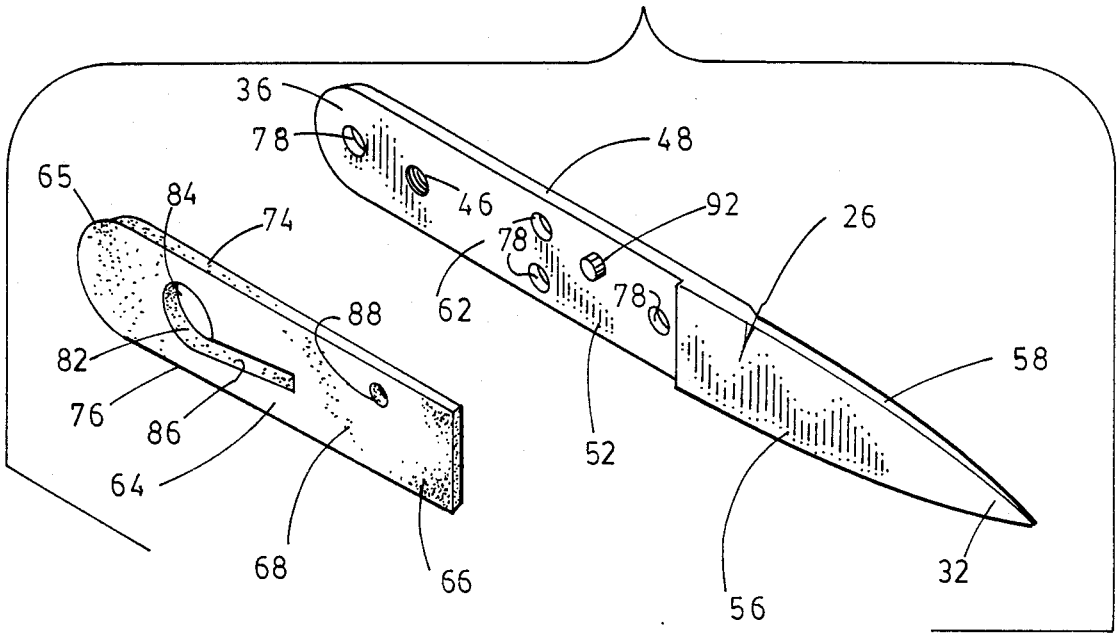
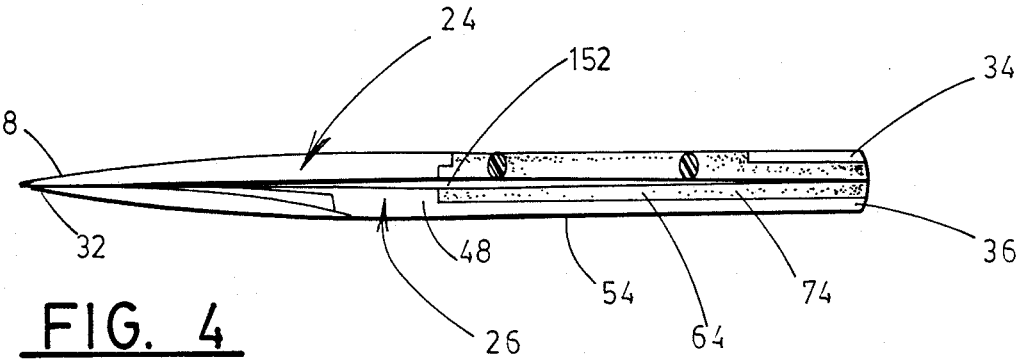
FIG. 4

FIG. 9
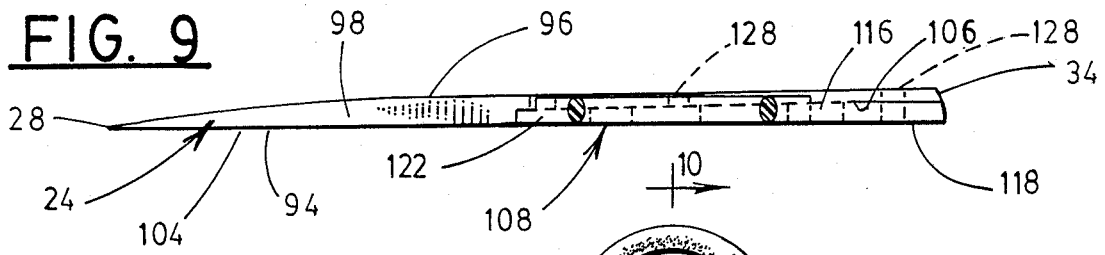
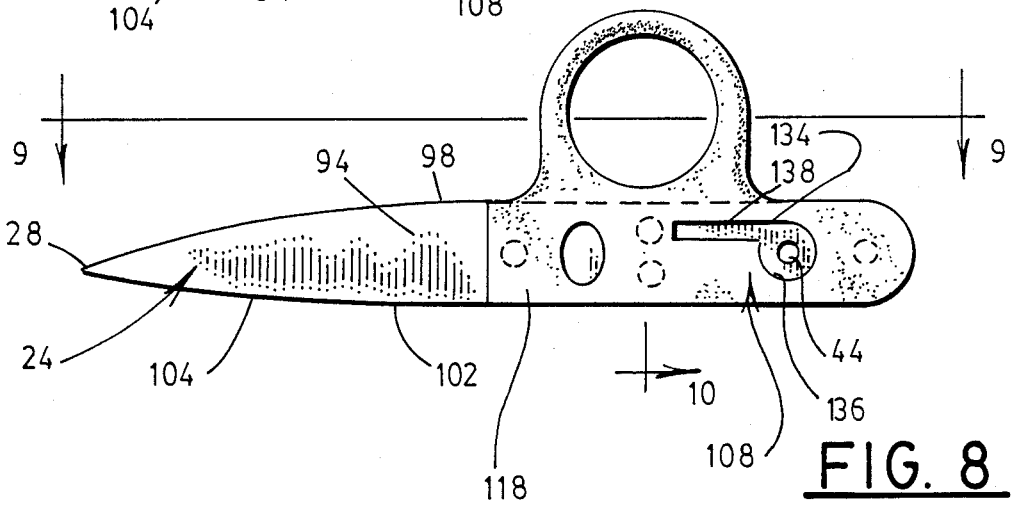
FIG. 8
FIG. 10
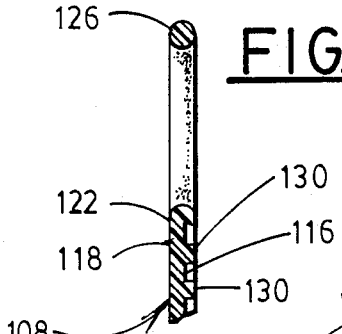
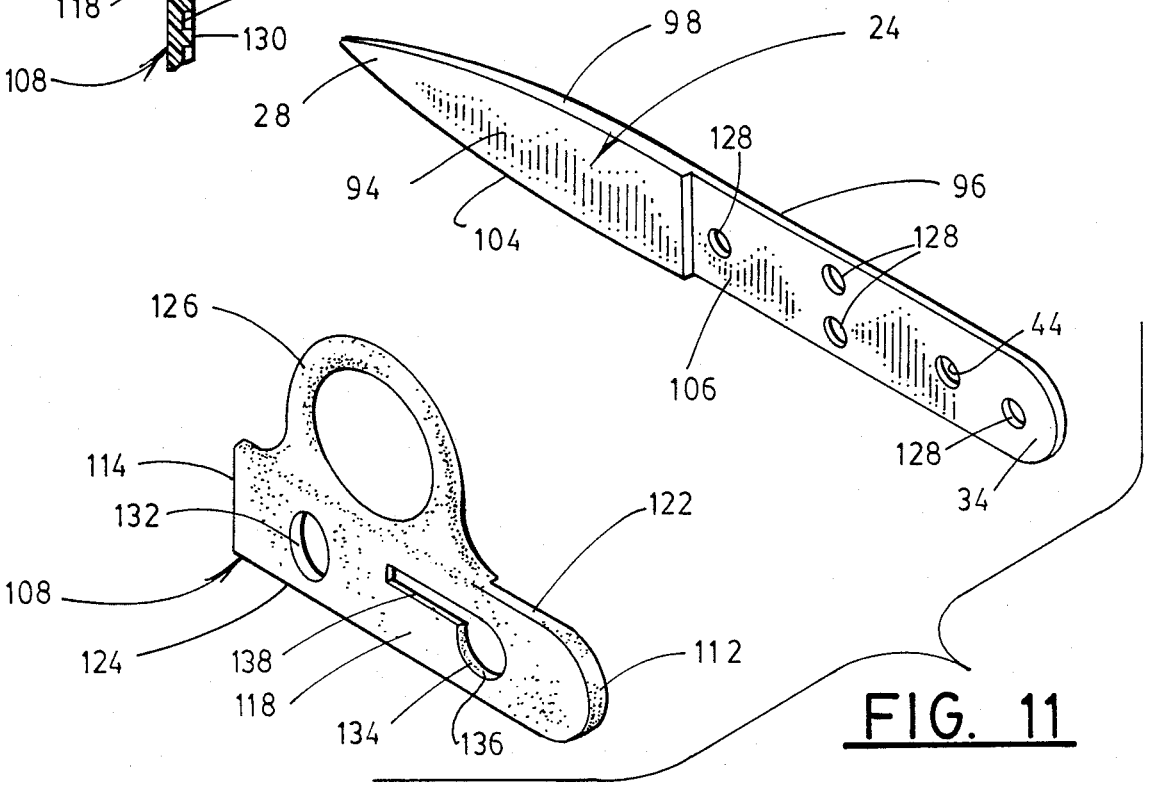
FIG. 11

THREAD SNIPS

This application is a continuation of application Ser. No. 07/293,991, filed Jan. 6, 1989, now abandoned.

BACKGROUND OF THE INVENTION

The present invention relates to thread snips and, particularly, to high-quality thread snips of the type employed in the garment and dressmaking industries.

Thread snips are small, scissors-like cutting tools utilized by professional seamstresses, tailors, and other garment makers to cut threads and the like during the making of dresses and other garments. They generally comprise two substantially flat steel blades that are disposed side-by-side and that have cooperating, sharpened cutting edges adjacent to their front pointed ends. The blades are pivoted or hinged together about a transverse pivot shaft located adjacent their rear, rounded or blunted ends so that their front sharpened ends may be opened and closed. Examples of such thread snips are described in U.S. Pat. Nos. 3,453,731 and 3,608,196.

The manufacture of conventional, high-quality thread snips requires a number of expensive machining operations and extensive hand work, approximately a third of which can normally only be done by skilled, experienced artisans. The blades used in such high-quality thread snips are forged from stainless steel so as to form the conventional, integral finger ring and the pockets to receive the ends of the spring used to bias the metal blades apart, that is, to their open position. The metal blades must also be drilled to receive the pivot shaft that serves to connect the blades together. The side of one of the blades has to be tapped and threaded to receive a stop screw. That screw projects from the side of the blade and into an elongated, aligned slot that is milled into the inner facing side of the other blade. The stop screw and slot cooperate to limit the degree of opening and closing of the blades. The metal blades must be finished or polished and have cutting edges honed along the forward portions of their front pointed ends.

An important part of the "art" of making high-quality thread snips, like the making of high-quality scissors, is in the shaping and bending of the stainless steel blades so that their cutting edges will cross or contact each other at a point and so that this crossing and contacting point will move forward, along the cutting edges, as the blades are closed during a cut. How skillfully the blades are bent or arched, and how this bend or arch comes out during cutting, determines the quality of the "feel" of the cutting action of the thread snips, as well as how long the cutting edges will retain their sharpness. If the blades are not bent properly, the blades will pass, side-by-side, like a guillotine. Rather than cut materials, particularly heavy materials, the blades will then just fold the material over, that is, the material will force the blades apart so that it just passes between them. If the blades are bent too much, the "feel" will be heavy or hard and thus be unacceptable to a seamstress or similar professional tradesperson who must use the thread snips throughout his or her work day. Additionally, the cutting edges will become dull relatively rapidly. This is a serious economic drawback since thread snips are usually discarded, rather than resharpened, after they have become dull.

In an effort to maintain a consistently acceptable "feel," some high-quality thread snips, such as those sold under the CUTRITE trademark by John A. Eberly, Inc. of Syracuse, N.Y., partially affect the bending of the blades by biasing them apart at a point to the rear of the blade pivot shaft. More specifically, these thread snips employ a small, coil compression spring biased ball that urges the rear ends of the blades apart. This serves to bend or arch the blades. Adding this feature obviously increases the cost of manufacturing, but it does provide a more uniform "feel" and cutting action that could otherwise only be consistently achieved through the expenditure of a commercially unacceptable amount of time by skilled craftsmen.

In an apparent attempt to reduce manufacturing costs, others have made thread snips with molded, plastic blades. Metal knife sections are attached or secured to the fronts of the plastic blades and serve as the sharpened, pointed ends of the snips, as well as providing the cutting edges necessary for the thread snips. Examples of such plastic thread snips are described in U.S. Pat. Nos. 3,453,651, 3,524,363, and 4,089,113.

One of the serious drawbacks with such plastic thread snips is that the plastic blades have to be relatively large and bulky in order to have sufficient strength to provide even a reasonably good cutting action. This larger size and bulk is perceived as a significant disadvantage by people, principally women, whose jobs require them to use a thread snip all or most of their working day.

SUMMARY OF THE DISCLOSURE

A primary object of the present invention is to provide an improved thread snips that have the same superior feel, cutting ability, and workmanship as the prior conventional, high-quality stainless steel thread snips but that can be manufactured for a fraction of the cost of the conventional thread snips. A related object of the present invention is to provide an improved lighter weight thread snips, as described, that will have a consistently appropriate blade bend or arch, thread snip after thread snip, without the need to employ a spring biased ball to urge the rear ends of the blades apart or to have a skilled artisan spend inordinate amounts of time carefully bending or shaping the blades. Still another object of the present invention is to provide an improved thread snips, as described, where a craftsman is not required to forge the metal blades to form the finger ring and spring pockets or to tap, thread and mill the metal blades to fashion the cooperating stop screw and slot used to limit the relative movement between the blades.

These objects and advantages of the present invention are achieved by making the stainless steel thread snip blades so that their inner facing side portions, adjacent to the rear ends of the metal blades, have a reduced thickness, as measured between their inner and outer facing side surfaces. Plastic inserts are then molded onto those reduced thickness portions of the metal blades so that when the thread snips are assembled, the inner facing sides of these plastic inserts face each other. These plastic inserts have the same general shape and dimensions as the reduced thickness portions of the metal blades. Their inner facing side surfaces define a generally smooth continuation of the inner facing side surfaces of the metal blades.

The plastic inserts are, however, made thicker adjacent to the rear ends of the metal blades than they are adjacent to the front ends of the blades. The additional "rear" thicknesses urge or force apart the rear ends of the metal blades, that is, the portions of the blades to the rear of the pivot shaft. By selection of the predetermined rear thicknesses, the metal blades will be appropriately bent or arched so as to achieve the desired "feel" and cutting action without the need for any significant additional labor by experienced, skilled artisans.

A finger ring is molded as an integral part of one of the plastic inserts. Spring pockets are also molded into the plastic inserts. The metal blades can thus be stamped instead of forged. This and the avoidance of having to machine and finish the finger ring and spring pockets significantly reduces the cost of manufacturing the blades. Similarly, the slot used to limit the relative opening movement of the metal blades can be molded in one of the plastic inserts, and if desired, a cooperating projection, can be molded on the other plastic insert, and may be used instead of the stop screw. The employment of the plastic inserts significantly reduce costs since they eliminate manufacturing operations. They also reduce the overall weight of the snips.

Preliminary comparative evaluations of the manufacturing costs of the improved thread snips of the present invention, vis-a-vis the prior high-quality, all-stainless steel thread snips, discloses a cost savings of as much as fifty percent. Notwithstanding this significant reduction in manufacturing costs, the improved thread snips of the present invention provides the same high-quality, long-lasting cutting action and feel as those prior more expensive, high-quality thread snips, while being considerable lighter in weight. This latter advantage is significant to a person, such as a woman, who must use the snips through the entire workday.

Further, the improved thread snips can be attractively personalized by adding a colored dye or pigment to the plastic used for the plastic inserts. This is an important, marketing feature since the sales of thread snips tend to be made or directed by women customers/users.

In summary, the present invention provides improved thread snips having the same superior cutting action, and consistently proper feel heretofore found only in the highest quality all-metal thread snips while having a manufacturing cost that is but a fraction of that of these all-metal snips. This reduction of manufacturing costs does not, however, impose commercially unacceptable penalties, such as the increase in size and bulkiness found in plastic thread snips. In addition, the improved thread snips of the present invention are much lighter and ergonomically easier to use over the long periods of continuous, repetitive work performed by professional seamstresses, tailors, and other garment workers.

DESCRIPTION OF THE DRAWINGS

These and other objects and advantages of the present invention will be even more apparent from the following description of the preferred embodiment of the present invention when read in conjunction with the figures of the drawings which include:

FIG. 4 is a top plan, partial cross-sectional view taken along the line 4—4 of FIG. 2 except that the tips of the blades are shown facing in the opposite direction;

FIG. 5 is a top, plan view of the left metal blade and plastic insert as shown in FIGS. 1–3;

FIG. 6 is a right side plan view of the inner facing side surface of the and plastic insert shown in FIG. 5;

FIG. 7 is a perspective, exploded view of the metal blade and plastic insert shown in FIGS. 5 and 6;

FIG. 8 is a side plan of the inner facing side surface of the right metal blade and plastic insert as shown in FIGS. 1–3 except that the tip of the blade is shown facing in the opposite direction;

FIG. 9 is a top plan, partial cross-sectional view taken on the line 9—9 in FIG. 8;

FIG. 10 is a vertical cross-sectional view taken along the line 10—10 in FIG. 8;

FIG. 11 is a perspective, exploded view of the metal blade and plastic insert shown in FIGS. 8–10.

DESCRIPTION OF THE PREFERRED EMBODIMENT

Figure 1:
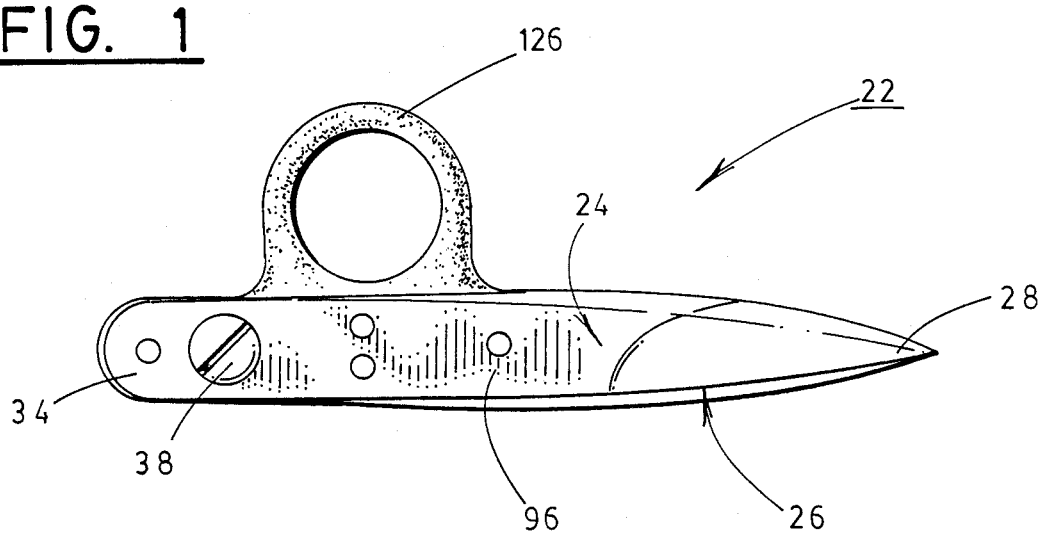
FIG. 1 is a right side plan view of an improved thread snips of the present invention shown with the blades in their closed position.

Referring now to FIGS. 1–4, the preferred embodiment of the improved thread snips of the present invention is shown generally at 22. These thread snips 22 comprises two metal blades 24 and 26 that may be conventionally stamped from 420 high carbon stainless steel and that are then heat treated and ice tempered in a conventional manner. The blades 24 and 26 have front, relatively pointed ends 28 and 32, respectively, and rounded, blunt rear ends 34 and 36, respectively.

Figure 2:
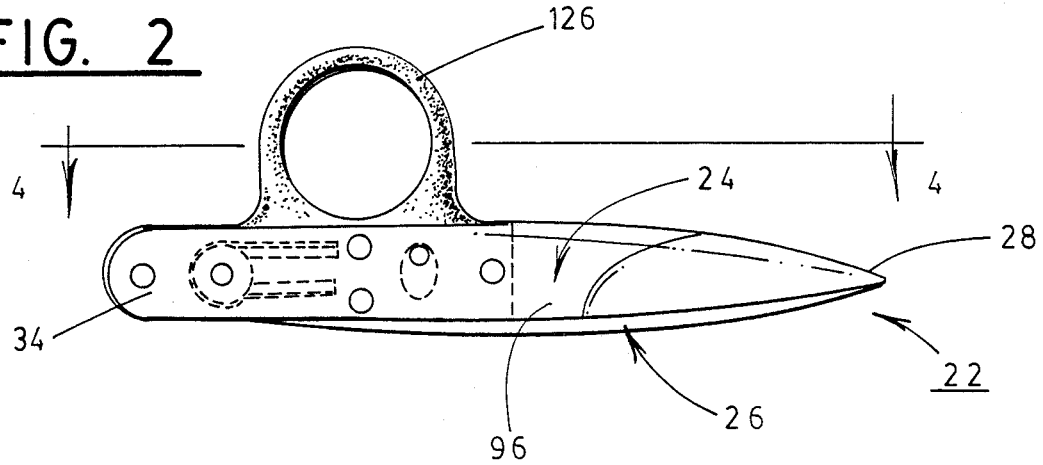
FIG. 2 is a side plan view, similar to FIG. 1, except that the basic internal structure of the plastic inserts is shown partially in dotted lines.
Figure 3:
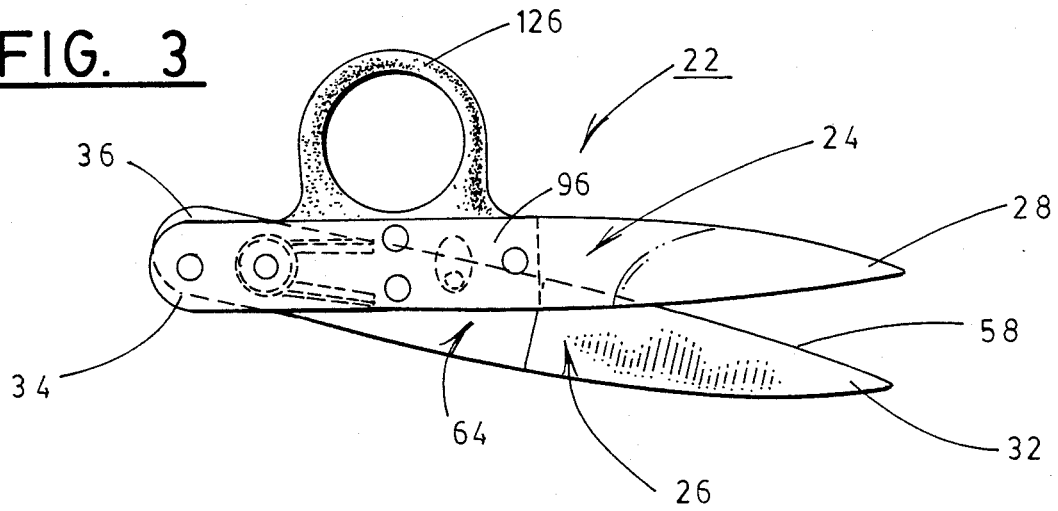
FIG. 3 is a side plan view, similar to FIG. 2, with the blades being shown in their opened position.
Figure 12:
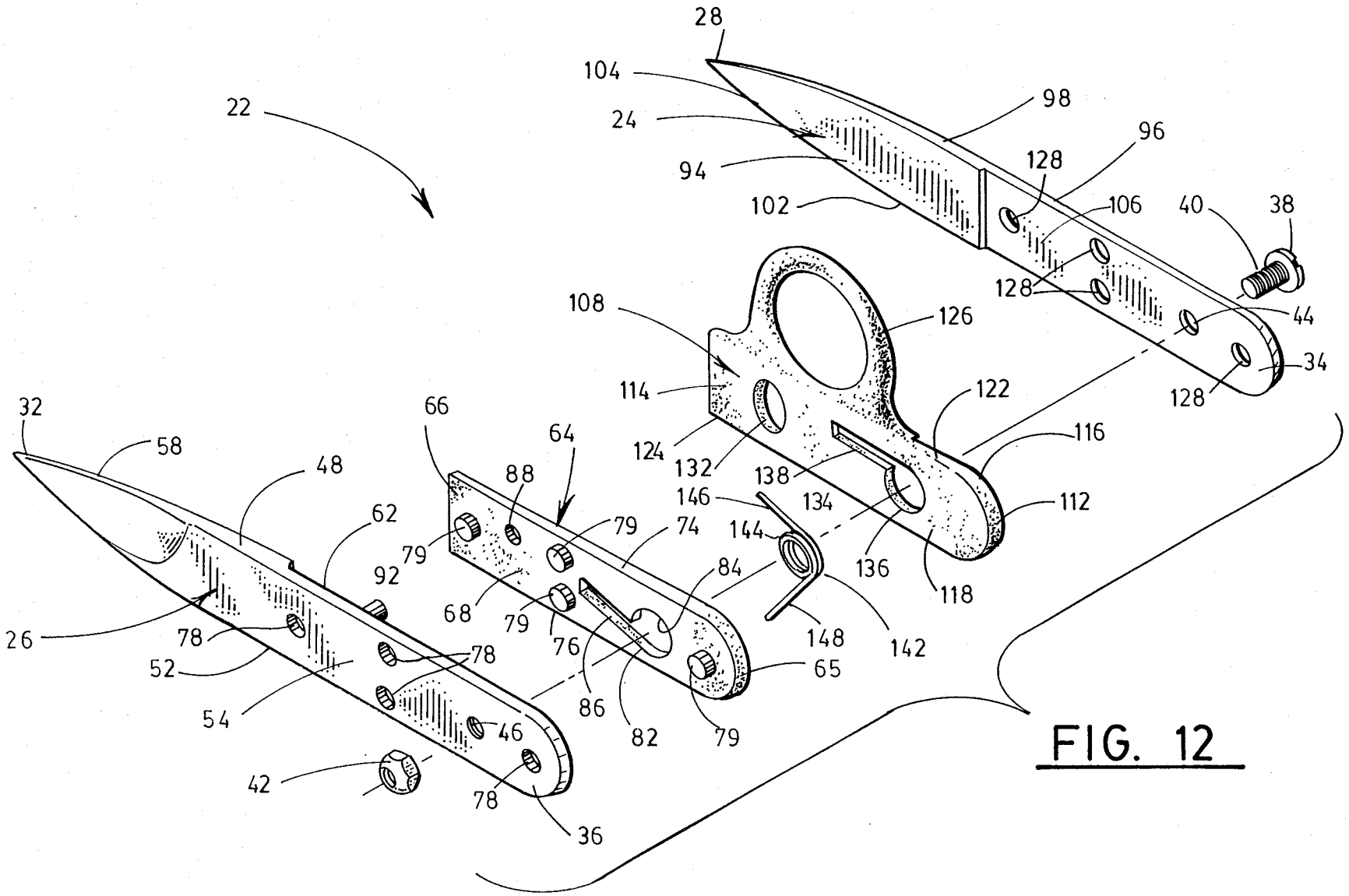
FIG. 12 is a perspective exploded view of the improved thread snips of invention.

As best shown in FIG. 12, a bolt 38 and Nut 42 secure or connect the metal blades 24 and 26 together, adjacent their rear ends 34 and 36. This nut and bolt connection permits the blades, and particularly their front ends 28 and 32, to be moved relative to each other, in planes generally parallel to the planes of the blades, from a closed position, such as shown in FIGS. 1 and 2, to an open position, such as shown in FIG. 3. The bolt 38 includes a threaded shaft 40 that extends through apertures 44 and 46 in the blades 24 and 26, respectively. The aperture 46 is threaded to receive the shaft 40.

As best illustrated in FIGS. 5–7 and 12, the metal blade 26 has upper and lower longitudinal edges 48 and 52, an outer facing side surface 54, and an inner facing side surface 56. A cutting edge 58 is sharpened or honed along the front portion of the upper longitudinal edge 52 so that this cutting edge extends from the tip of the front end 32 rearwardly a predetermined distance towards the rear end 36.

During manufacture, the blade 26 is stamped such that its rearward portion 62 has a reduced thickness, as measured between its outer facing side surface 54 and its inner facing side surface 56. This rearward, reduced thickness portion 62 extends a second predetermined distance forwardly from the rear end 36, but does not, however, overlap with the rearward end of the cutting edge 58. The underlying part of the metal blade 26 (that is, the part that defines the reduced thickness portion 62) preferably has a uniform thickness.

A first plastic insert 64 is disposed within the reduced thickness portion 62. This plastic insert has a rounded blunt rear end 65 and a front end 66 with a shape that is congruent with the forward end of the reduced thickness portion 62. It also has an outer facing side surface 68 and an inner facing side surface 72 as well as upper and lower longitudinal edges 74 and 76, respectively. The dimensions of the insert 62 are selected so that when the plastic insert 64 is disposed in the reduced thickness portion 62, its rear end 65 coincides with the rear end 36 of the metal blade 26 and its upper and lower longitudinal edges 74 and 76, are aligned with the upper and lower longitudinal edges 48 and 52 of the blade 26. The outer facing side surface 68 of the plastic insert 64 is adjacent to the blade's inner facing side surface 56, or at least that portion of it which is within the reduced thickness portion 62 of the blade 26.

Preferably the insert 64 is molded directly onto the blade 26 by conventional molding methods and apparatus. When this is done, the reduced thickness portion 62 of the blade will include a plurality of relatively small apertures 78. During the molding operation, plastic, as shown generally at 79 in FIG. 12, will flow into these apertures 78 and will then serve to secure or stake the insert 64 to the blade 26.

The plastic insert 64 also includes a spring pocket 82 that has a center section 84 and an elongated arm section 86. The center section 84 is generally circular in shape and its central longitudinal axis is generally aligned with the central longitudinal axis of the aperture 46 in the blade.

The plastic insert 64 also includes another aperture 88 that is aligned with and adapted to receive a set screw 92 threaded into the inner facing side surface 56 of the metal blade 26. More specifically, the distal end of the set screw 92 projects through and beyond the inner facing side surface 72 of the insert 64 when the insert is mounted on the metal blade 26. It is contemplated, however, that the aperture 88 and set screw 92 may be replaced by a projection that would be an integrally molded part of the plastic insert 64 and that would be located where the aperture 88 is now positioned. This projection would extend perpendicularly from the inner facing side surface 72 of the insert 64, and would serve the same function as the distal end of the set screw 92.

The arm section 86 of the spring pocket 82 extends at a small angle upwardly, with respect to the horizontal, or more particularly to the lower longitudinal edges 52 and 76 of the metal blade 26 and plastic insert 64, respectfully. Preferably this angle is approximately 5 degrees. The reason for disposing this arm section 86 at such an angle as to provide more material between it and the lower longitudinal edge 52. This additional material will resist defamation of the plastic by the end of a spring as hereinafter described.

Referring now to FIGS. 8–11, the metal blade 24, like the blade 26, is preferably made by a conventional stamping process. The blade 24 has an inner facing side surface 94, an outer facing side surface 96, an upper longitudinal edge 98, and a lower longitudinal edge 102.

The metal blade 24 also includes a cutting edge 104 sharpened or honed along its upper longitudinal edge 98 and extending from the tip of its front end 28 rearwardly a predetermined distance. The length of the cutting edge 104 is selected so that it is approximately equal to the length of the cutting edge 58 on the metal blade 26.

The metal blade 24 includes a rearward portion 106 that has a reduced thickness, as measured between its inner and outer facing side surfaces 94 and 96. This reduced thickness portion 106 extends forwardly from the rear end 34 of the blade 24 a predetermined distance. The underlying part of the metal blade 24, that is, the part that defines the reduced thickness portion 106 has a uniform thickness. In practice, the reduced thickness portion 106 has a length, as measured along the longitudinal axis of the blade 24, substantially equal to the length of the reduced thickness portion 62 of the metal blade 24.

A second plastic insert 108 is adapted to be disposed within the reduced thickness portion 106 of the metal blade 24. The plastic insert 108 includes a rear end 112, a forward end 114, an outer facing side surface 116, an inner facing side surface 118, an upper longitudinal edge 122, and a lower longitudinal edge 124. The dimensions and shape of the plastic insert 108 are selected so that when this plastic insert is disposed within the reduced thickness portion 106 of the metal blade 24, its rear end 112 coincides with and is aligned with the rear end 34 of the blade, its upper and lower longitudinal edges 122 and 124 are substantially aligned with the upper and lower longitudinal edges of 98 and 102, respectively, of the metal blade 24 adjacent the reduced thickness portion 106.

Unlike the plastic insert 64, the insert 108 also includes an upwardly directed, integral portion 126 that extends upwardly beyond its upper longitudinal edge 122 and beyond the upper longitudinal edge 98 of the metal blade 24. This upper portion 126 is formed in the shape designed to accommodate or receive a person's finger. In other words, the upper portion 126 defines and forms a finger ring that has the same general shape as the finger rings found in the conventional, all-metal thread snips.

Like with plastic insert 64, it is preferred that the insert 108 be molded directly onto the metal blade 24. For this reason the metal blade 24 also includes a plurality of relatively small apertures 128, similar to the apertures 78, that are designed to receive molded plastic material, shown generally at 130 in FIG. 10, when the insert 108 is molded onto the metal blade 24. The plastic material that extrudes into these apertures 128 serves as the means to secure or stake the plastic insert 108 to the metal blade 24.

The plastic inserts 64 and 108 may preferably be made from plastic material sold under the DELRIN and NYLON trademarks by E. I. du Pont de Nemours and Company or polycarbonate plastic material sold under the MERLON trademark by Mobay Plastics Co.

The second plastic insert 108 includes an elliptical slot or pocket 132 and a spring pocket 134. When the blades 24 and 26 are secured together, as shown in FIGS. 1–4, the slot 132 is aligned with and is adapted to receive the distal end of the set screw 92 or the molded projection. The major axis of the slot 132 is selected so that the set screw 92 or projection will cooperate with the slot 132 to limit the degree or amount that the blades 24 and 26 can be pivoted relative to each other, that is, to limit the amount that forward ends 28 and 32 of the blades can be spread apart, when the thread snips 22 is moved to its open position as best shown in FIG. 3. The set screw and slot also limit further closing movement of the metal blades 24 and 26 after they have once reached their closed position, as best shown in FIGS. 1 and 2.

The spring pocket 134 includes a central generally circular portion 136 and an elongated arm section 138. The arm section is disposed generally parallel to the upper and lower elongated edges 122 and 124 of the insert 108. The longitudinal central axis of the central section 136 is aligned with the axes of the apertures 44 and 46 and the central section 84 of the spring pocket 82 when the thread snips 22 are assembled as shown in FIGS. 1–3 and 12.

Referring now to FIG. 12, a conventional metal spring 142 is adapted to be disposed in the spring pockets 82 and 134. It has a generally cylindrical central section 144 which is adapted to be loosely received within the center sections 84 and 136. This spring 142 also has two arms 146 and 148 which are normally disposed at an angle with respect to each other. The end 146 is adapted to be disposed and retained within the arm section 138 in plastic insert 108. Similarly, the end 148 is adapted to be disposed and retained within the arm section 86 in the plastic insert 64. The ends of the spring 142 exert sufficient force on the metal blades 24 and 26 through the plastic inserts 64 and 108 sufficient such that the metal blades are normally biased to their open position as shown in FIG. 3.

As noted before, part of the "art" of making high quality thread snips, like high quality scissors, is in bending or arching the blades such that these blades will cross and contact, at a point, along their cutting edges. Preferably this crossing point should be adjacent to their forward or front ends 28 and 32 of the blades 24 and 26, respectively, when the snips are in their closed position as shown in FIGS. 1 and 2. As the blades are moved to their fully open position, as best shown in FIG. 3, this point of contact should move rearwardly along the cutting edges 58 and 104. This proper cutting action and feel is achieved by initially bending or arching the blades, between their ends, so that the bend or arch will come out, that is, the blades will straighten adjacent to the contact point as the contact point moves during the opening and closing of the blades.

One of the principal advantages of the present invention is that a significant portion of this bending or arching can be achieved by controlling the thickness of the plastic inserts 64 and 108. More specifically, it has been found that when the rear ends 65 and 112 of these plastic inserts are made slightly thicker than their front ends 66 and 114, a highly desirable bend or arch will be imposed in the metal blades 24 and 26. In other words, this increased thickness forces apart the rear ends 34 and 36 of the blades 24 and 26 (that is, the portion of the blades to the rear of the attachment bolt 38). This causes the forward ends of the blades to bend or arch so that there is a spacing or gap 152 (as best shown in FIG. 4) between the inner facing side surfaces 94 and 118 of the blade 24 and insert 108, respectively, on the one hand, and the inner facing side surface 56 and 72 of the blade 26 and insert 64, respectively, on the other hand.

A preferred way of achieving this difference in thickness is to define the inner facing side surfaces 72 and 118 of the inserts as a part of a sector of the inside surface of a cylinder. In this regard, the thicknesses of the front ends 66 and 114 of the plastic inserts 64 and 108 are selected such that their inner facing side surfaces 74 and 118, preferably form a smooth continuation of the inner facing side surfaces 56 and 94 of the metal blades 26 and 24 themselves. In thread snips having an overall blade lengths of approximately 4.5 inches and where the length of the plastic inserts is approximately 2.3 inches, the thickness of each of the inserts, adjacent to their front ends, is approximately 0.07 inches, and the thicknesses of the inserts, adjacent to their rear ends 65 and 112 is approximately 0.085 inches. As noted above, this variation in the thickness of the inserts can be achieved if each of the plastic inserts is made such that its inner surface forms a sector of the inside surface of a cylinder having a radius of approximately 41.8 inches, where the center of the cylinder is located approximately 1.163 inches to the rear of a plane that is perpendicular to the adjacent side surface of the blade and that includes the front end the insert.

As will be recognized by those having skill in the thread snips art, the thickness dimensions of the plastic inserts may vary, inter alia, with variations in the overall length of the metal blades. Similarly, it is presently believed the inner facing side surfaces 74 and 118 of the plastic inserts 64 and 108 can be made in shapes other than sectors of a cylinder. For example, it is believed that the inner facing side surfaces 74 and 118 can be formed as a series of small steps if desired. Nevertheless, the above-described preferred embodiment of the present invention constitutes the best mode now contemplated by the inventors for carrying out their invention. Thus and because their invention may however be copied without copying the precise details of this preferred embodiment, the following claims particularly point out and distinctly claim the subject matter which the inventors regard as their invention and wish to protect.

We claim:

1. An improved thread snips comprising:

a first metal blade including: a first, front relatively pointed end; a second, generally rounded rear end; an inner facing side surface; an outer facing side surface; and first and second longitudinal edges extending between the first and second ends, with the first metal blade having a sharpened cutting edge that extends along a portion of its first longitudinal edge and rearwardly from its first end a first predetermined distance and also having a reduced thickness portion that has a different thickness, as measured from the inner facing side surface, with the reduced thickness portion extending between its first and second longitudinal edges and forwardly a second predetermined distance from its second end, facing the same direction as the inner facing side surface, having a predetermined shape, and having predetermined length and width dimensions;

a second metal blade including: a first, front relatively pointed end; a second, generally rounded rear end; an inner facing side surface; an outer facing side surface; and first and second longitudinal edges extending between the first and second ends, with the second metal blade having a sharpened cutting edge that extends along a portion of its first longitudinal edge and rearwardly from its first end a first predetermined distance;

a first plastic insert that has longitudinal edges, and that has an inner facing side surface and an oppositely facing side surface;

means for securing the first plastic insert within the reduced thickness portion of the first metal blade so that the inner facing side surface of the first plastic insert faces in the same direction as and is generally a continuation of the inner facing side surface of the first metal blade;

means for connecting the first and second metal blades together, between their ends, so that the metal blades are disposed side by side, with their respective inner facing side surfaces and their respective cutting edges being adjacent, so that the first and second ends of the first metal blade coincide with the first and second ends, respectively, of the second metal blade, so that the first and second metal blades may be moved, relative to each other, in planes generally parallel to their inner facing side surfaces and about an axis substantially perpendicular to their inner facing side surfaces whereby the cutting edges of the metal blades may cooperate together and provide a cutting action therebetween, with the axis being located between the ends of the first and second metal blades and between the longitudinal edges of the first and second metal blades;

means for biasing the first and second metal blades apart in the planes generally parallel to their inner facing side surfaces; and means for limiting the angle, about the axis, through which the first and second metal blades may move, relative to each other, in the planes generally parallel to their inner facing side surfaces.

2. The improved thread snips of claim 1 wherein the second metal blade has a reduced thickness portion that has a different thickness, as measured from the inner facing side surface, that extends between its first and second longitudinal edges, that extends a third predetermined distance forwardly from its second end, that faces in the same direction as the inner facing side surface of the second metal blade, that has a predetermined shape, and that has predetermined length and width dimensions; which includes a second plastic insert that has longitudinal edges, and that has an inner facing side surface and an oppositely facing side surface; and which includes means for securing the second plastic insert within the reduced thickness portion of the second metal blade so that the inner facing side surface of the second plastic insert faces in the same direction as the inner facing side surface of the second metal blade, and so that the inner facing side surface of the first plastic insert faces and is adjacent to the inner facing side surface of the second plastic insert.

3. The improved thread snips of claim 2 wherein the thickness, as measured between the inner and opposite side surfaces, of at least one of the first and second plastic inserts is greater adjacent to the second ends of the metal blades than it is adjacent to the first end of its metal blade; and wherein this greater thickness tends to force the inner facing side surfaces of the second ends of the first and second metal blades apart and thereby provide improved cutting action.

4. The improved thread snips of claim 2 wherein the reduced thickness portions of the first and second metal blades have a reduced thicknesses, as measured between their respective inner and outer facing side surfaces; wherein the thickness, as measure between the inner and opposite facing side surfaces, of each of the first and second plastic inserts is greater adjacent to the second ends of the first and second metal blades than it is adjacent to the first ends of the first and second metal blades; wherein the greater thicknesses tend to force the inner facing side surfaces of the second ends of the first and second metal blades apart and thereby provide improved cutting action; wherein the first plastic insert has a shape congruent to the shape of the reduced thickness portion of the first metal blade and has length and width dimensions substantially identical with the length and width dimensions of the reduced thickness portion of the first metal blade; wherein the second plastic insert has a shape congruent to the shape of the reduced thickness portion of the second metal blade and has length and width dimensions substantially identical with the length and width dimensions of the reduced thickness portion of the second metal blade; and wherein the longitudinal edges of the first and second plastic inserts are generally aligned with portions of the longitudinal edges of the first and second metal blades, respectively, rearwardly of their cutting edges.

5. The improved thread snips of claim 3 wherein the inner facing side surface of at least one of the first and second plastic inserts is generally concave and defines a sector of an inner surface of a cylinder; and wherein the inner facing side surface of the one plastic insert provides a generally smooth continuation of the inner facing side surface of its metal blade.

6. The improved thread snips of claim 4 wherein the inner side surface of the first plastic insert is generally concave and defines a sector of an inner surface of a first cylinder; wherein the inner side surface of the second plastic insert is generally concave and defines a sector of an inner surface of a second cylinder; wherein the inner facing side surface of the first plastic insert provides a generally smooth continuation of the inner facing side surface of the first metal blade; and wherein the inner facing side surface of the second plastic insert provides a generally smooth continuation of the inner facing side surface of the second metal blade.

7. The improved thread snips of claim 6 wherein the first and second cylinders have the same radii; and wherein the second and third distances are substantially the same.

8. The improved thread snips of claim 4 wherein one of the first and second plastic inserts includes an integral portion that projects from one of the longitudinal edges of the one plastic insert and beyond the adjacent longitudinal edges of the first and second metal blades; and wherein the projecting integral portion includes a finger ring.

9. The improved thread snips of claim 4 wherein the biasing means includes a spring having first and second ends that are disposed in two generally parallel, spaced apart planes, and that are normally disposed at an angle with respect to each other; wherein a first pocket is formed in the first plastic insert, with the first pocket opening to the inner facing side surface of the first plastic insert and receiving the first end of the spring; and wherein a second pocket is formed in the second plastic insert, with the second pocket opening to the inner facing side surface of the second plastic insert and receiving the second end of the spring.

10. The improved thread snips of claim 9 wherein the first pocket is disposed adjacent to but at an angle with respect to a longitudinal edge of the first plastic insert; wherein the connecting means includes a shaft that extends through the first and second plastic inserts and into the first and second metal blades; and wherein a portion of the spring, between its first and second ends, is coiled about a portion of the shaft that extends through the first and second plastic inserts.

11. The improved thread snips of claim 4 wherein each of the first and second metal blades include a plurality of relatively small apertures communicating with the reduced thickness portion of the metal blade; wherein the first plastic insert is molded onto the reduced thickness portion of the first metal blade so that the plastic may flow into each aperture in the first metal blade and serve as the means for securing the first plastic insert in the reduced thickness portion of the first metal blade; and wherein the second plastic insert is molded onto the reduced thickness portion of the second metal blade so that the plastic may flow into each of the apertures in the second metal blade and serve as the means for securing the second plastic insert within the reduced thickness portion of the second metal blade.

12. The improved thread snips of claim 2 wherein the limiting means includes an elongated pocket in one of the first and second plastic inserts, with the elongated pocket opening to the inner facing side surface of the one plastic insert, and a projection extending from the inner facing side surface of the other of the plastic inserts and into the elongated pocket.

13. The improved thread snips of claim 6 wherein one of the first and second plastic inserts includes an integral portion that projects from one of the longitudinal edges of the one plastic insert and beyond the adjacent of the longitudinal edges of the first and second metal blades; wherein the projecting integral portion includes a finger ring; wherein the biasing means includes a spring having first and second ends that are disposed in two generally parallel, spaced apart planes, and that are normally disposed at an angle with respect to each other; wherein a first pocket is formed in the first plastic insert, with the first pocket opening to the inner facing side surface of the first plastic insert and receiving the first end of the spring; and wherein a second pocket is formed in the second plastic insert, with the second pocket opening to the inner facing side surface of the second plastic insert and receiving the second end of the spring.

14. The improved thread snips of claim 13 wherein each of the first and second metal blades include a plurality of relatively small apertures communicating with the reduced thickness portion of the metal blade; wherein the first plastic insert is molded onto the reduced thickness portion of the first metal blade so that the plastic may flow into each aperture in the first metal blade and serve as the means for securing the first plastic insert into the reduced thickness portion of the first metal blade; wherein the second plastic insert is molded onto the reduced thickness portion of the second metal blade so that the plastic may flow into each of the apertures in the second metal blade and serve as the means for securing the second plastic insert within the reduced thickness portion of the second metal blade; and wherein the limiting means includes an elongated pocket in one of the first and second plastic inserts, with the elongated pocket opening to the inner facing side surface of the one plastic insert and a projection extending from the inner facing side surface of the other of the plastic insert and into the elongated pocket.

15. The improved thread snips of claim 14 wherein the first pocket is disposed adjacent to but at an angle with respect to a longitudinal edge of the first plastic insert; wherein the connecting means includes a shaft that extends through the first and second plastic inserts and into the first and second metal blades; and wherein a portion of the spring, between its first and second ends, is coiled about a portion of the shaft that extends through the first and second plastic inserts.

16. The improved thread snips of claim 15 wherein the first and second cylinders have the same radii; and wherein the second and third distances are substantially the same.

* * * * *